US007007310B2

(12) United States Patent
Chiang

(10) Patent No.: US 7,007,310 B2
(45) Date of Patent: Mar. 7, 2006

(54) INTEGRATED SWIMMING GOGGLES MECHANISM

(76) Inventor: Herman Chiang, 11F-2,NO,634-9, Ching-Ping Rd., Chung-Ho City, Taipei Hsien (TW)

( * ) Notice: Subject to any disclaimer, the term of this patent is extended or adjusted under 35 U.S.C. 154(b) by 221 days.

(21) Appl. No.: 10/610,766

(22) Filed: Jul. 2, 2003

(65) Prior Publication Data

US 2005/0015868 A1 Jan. 27, 2005

(51) Int. Cl.
*A61F 9/02* (2006.01)

(52) U.S. Cl. ..... 2/446

(58) Field of Classification Search ..... 2/445, 2/446, 428, 430

See application file for complete search history.

(56) References Cited

U.S. PATENT DOCUMENTS 5,524,300 A * 6/1996 Chiang ..... 2/439
5,802,620 A * 9/1998 Chiang ..... 2/428
6,513,170 B1 * 2/2003 Chiang ..... 2/428

* cited by examiner

*Primary Examiner*—Katherine M. Moran
(74) *Attorney, Agent, or Firm*—Troxell Law Office, PLLC

(57) ABSTRACT

The present invention provides an improved integrated swimming goggles mechanism. The swimming goggles of the present invention comprises a first frame made from rigid material and a second frame made from soft material. The first frame includes a pair of front lens frames each having a lens receiving grooves, a first bridge member which is connected with the inner sides of the front lens frames and has at least a joint section and at least a bending point. The second frame includes a pair of rear lens frames which are adjacent to the front lens frames and the second bridge member between the rear lens frame encircles the first bridge member. The rigid first frame mechanism provides fixing and assembling of the head strap of the swimming goggles. Due to the first bridge member and at least one bending point, the rigid first frame is provided with a desired flexibility. Moreover, the soft second frame can provide a comfort contacting with a user's face when the goggles are worn.

7 Claims, 4 Drawing Sheets

INTEGRATED SWIMMING GOGGLES MECHANISM

BACKGROUND OF THE INVENTION

1. Field of the invention

The present invention relates to a pair of integrated swimming goggles, more particularly, a pair of improved integrated swimming goggles mechanism including the lens frames, the bridge member, and gaskets. The frames each are made of soft and rigid material so as to provide a comfort contact with a face and avoid deformation because of pulling of the head strap. Moreover, The bridge member provides a desired flexibility.

2. Description of the Related Art

Referring to FIG. 1 is disclosed in the R.O.C. Laying-Open Gazette of utility model patent No. 83200405 (represented as Patent '405 for following description), which a pair of integrated type swimming goggles of the prior art includes a pair of lens frames, a bridge member, and a pair of gaskets. The swimming goggles disclosed by Patent '405 and integratedly including the lens frames, the bridge member, and the gaskets shall provide the soft material to the gasket adjacent to a user's face thereby providing a comfortable wearing. A portion on the lens frame for passing therethrough by the head strap shall withstand the pulling strength thereby avoiding the deformation of the lens frame. Therefore, the structure feature of Patent '405 discloses a pair of swimming goggles 70 integratedly molded from a soft material and including a pair of lens frames, 71, 72, a bridge member 73, and a pair of gaskets 74, which are all made from the soft material. In order to avoid the deformation of the lens frames 71, 72 when wearing, the cross-section of the bridge member 73 is arcuated, and the center portion thereof is comparatively thick and the lateral portion thereof is comparatively thin. The lateral portions of the lens frames 71, 72 form a pair of stop members 75 such that the pressing end 77 of the head strap 76 is stopped by the stop member. Therefore, when the head strap 76 is pulled for wearing the goggles, the pulling strength shall be spread over the stop member 75 and the comparatively thick central portion of the bridge member 73 thereby avoiding the deformation of the lens frames 71, 72.

Moreover, the bridge member of such type integrated swimming goggles is positioned on the inner sides of the lens frames. The width for wearing the goggles is limited within a certain range. However, the face shape is different from a user to a user. The bridge member shall be provided with proper flexibility to meet the actual requirement of wearing.

Therefore, with the above mention the description, it should be understood that the design of such the integrated goggles should involve those concerning factors, e.g. a comfort feeling for the face when wearing, the deformation effect due to the pulling of the head strap, and the desired flexibility of the bridge member. Based on the above-mentioned basic theory and the spirit of keep improving and innovation, the inventor makes the present invention.

SUMMARY OF THE INVENTION

The main object of the integrated goggles of the present invention is to provide the integrated goggles providing a comfort feeling of wearing and avoiding the deformation of the lens frames. The lens frame adjacent to face is made from soft material. The portion for being extended through by the head strap is made from rigid material. Therefore, the head strap of the swimming goggles may be fixed on the rigid material portion so as to provide a comfort wearing and avoiding deformation of the lens frames.

The second object of the integrated goggles is that the bridge member of the swimming goggles has a desired flexibility. When the swimming goggles are used, the lens frames are convenient for being worn and can be properly contacted with heads with different face shapes thereby providing a comfort effect.

To fulfill to the above-mentioned object, the improved integrated swimming goggles of the present invention features in that the swimming goggles comprises a first frame made from rigid material and a second frame made from soft material. The first frame includes a pair of front lens frames each having a lens receiving grooves, a first bridge member which is connected with the inner sides of the front lens frames and has at least a joint section and at least a bending point. The second frame includes a pair of rear lens frames which are adjacent to the front lens frames. At least one portion of the rear lens frame encircle the front lens frame, respectively. That is, the second bridge member between the rear lens frame encircles the first bridge member. Due to the first bridge member and at least one bending point, the second bridge member adopts the bending point as a central point thereby providing the front lens frames and the rear lens frames of the assembled first and second frames with a desired flexibility.

DETAILED DESCRIPTION OF THE PREFERRED EMBODIMENTS

Figure 1:
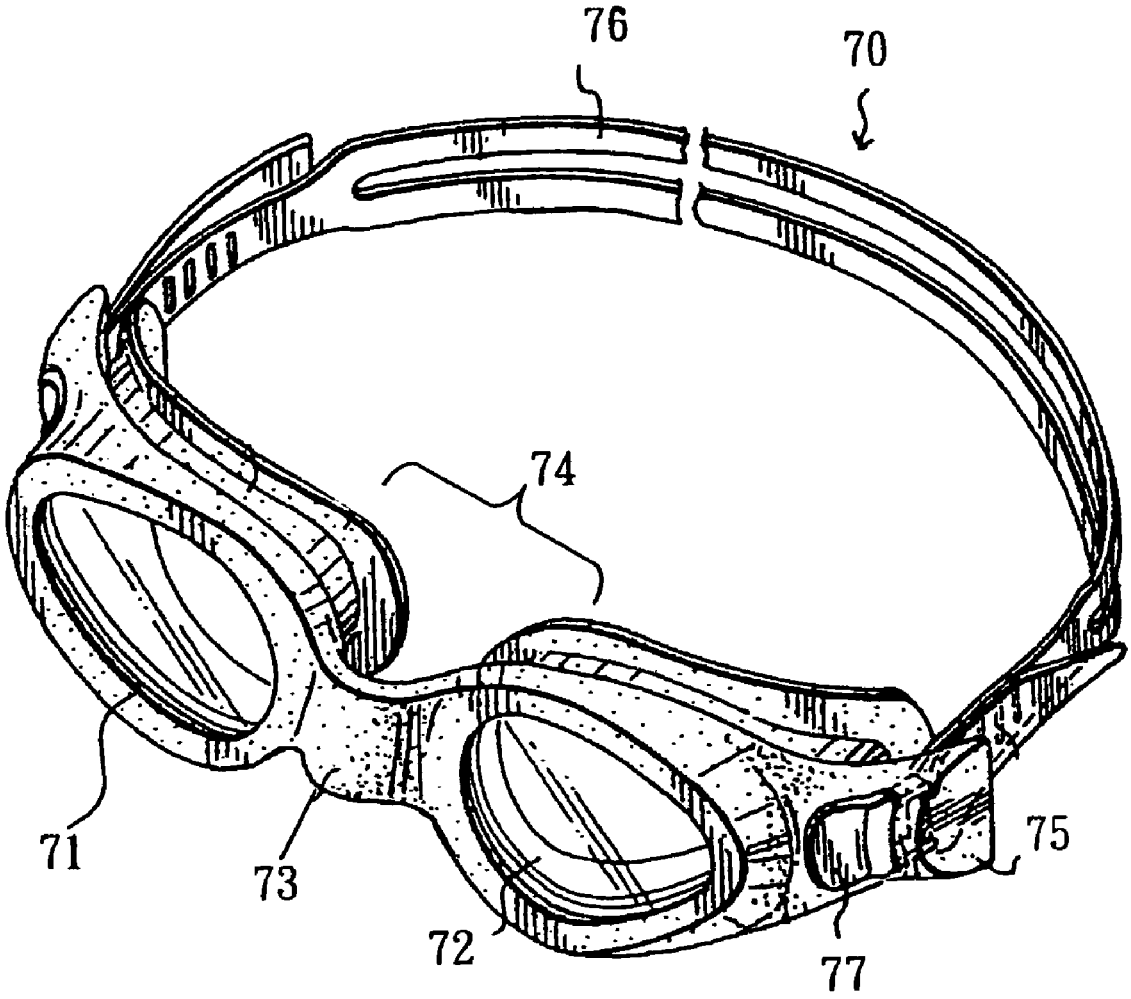
FIG.1 PRIOR ART
FIG. 1 is the perspective view of the invention of the Patent 83200405 of Republic of China.
Figure 2:
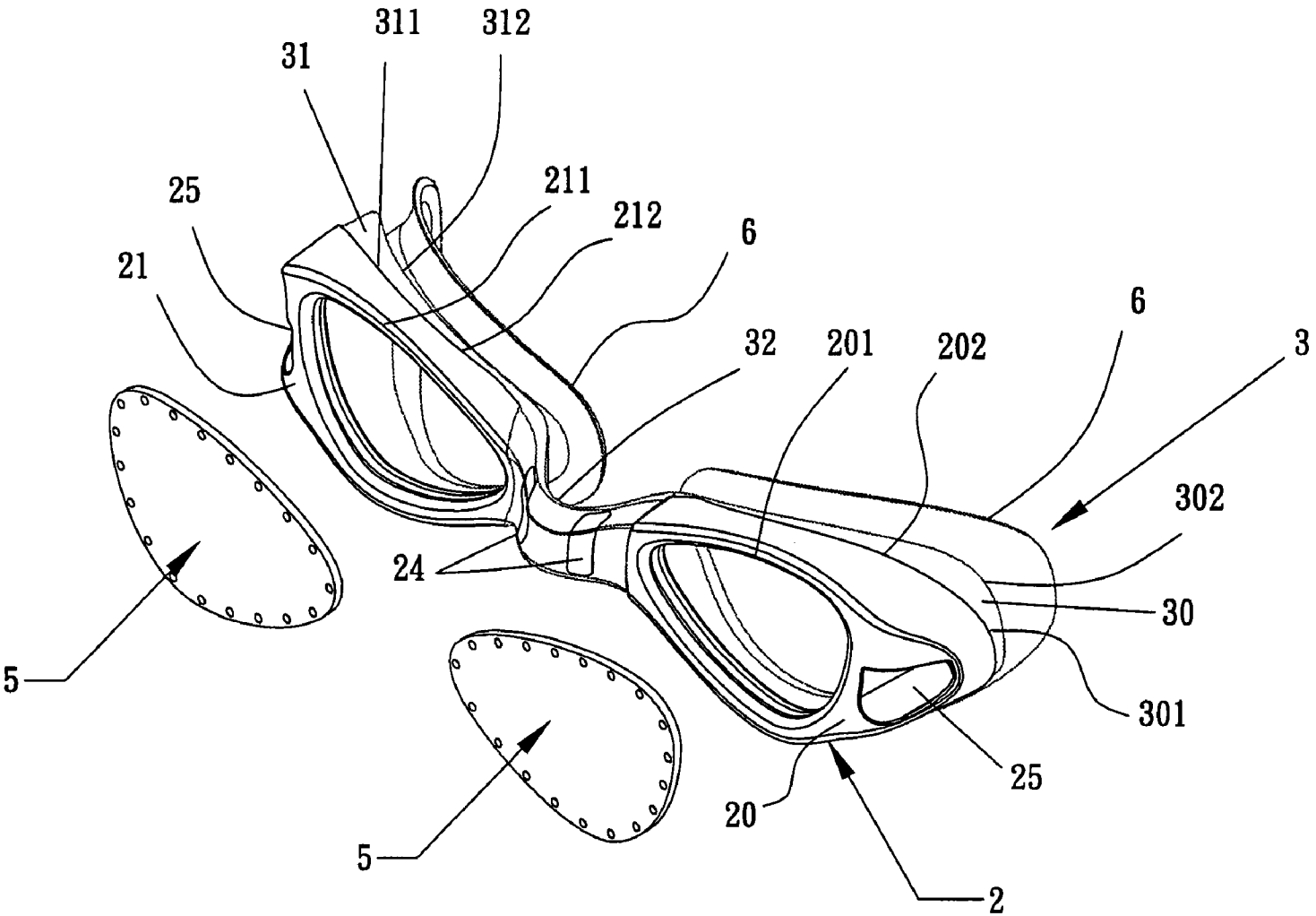
FIG. 2 is an exploded view of an improved integrated swimming goggles mechanism of the present invention.
Figure 3:
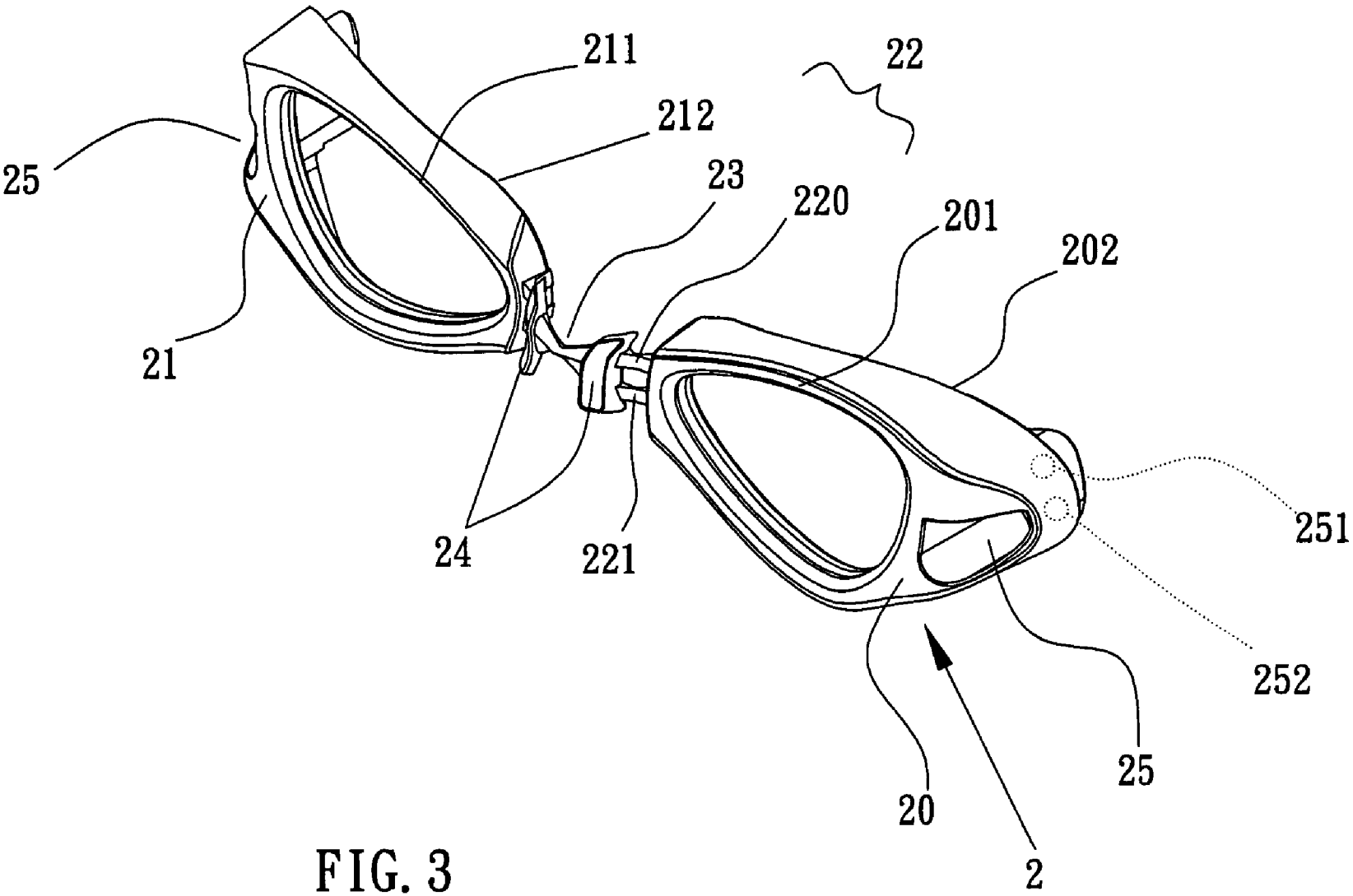
FIG. 3 is a perspective view of the first frame of the improved integrated swimming goggles mechanism of the present invention.
Figure 5:
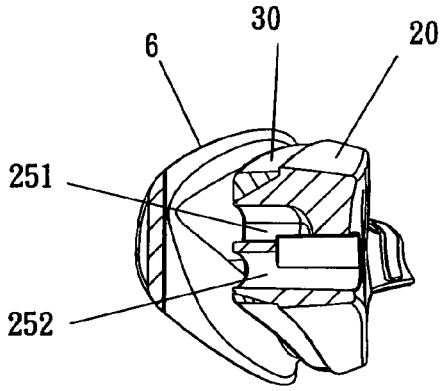
FIG. 5 is a cross-section view taken from line 4—4 of FIG. 4

Referring to FIG. 2, a pair of integrated swimming goggles of the present invention comprises a first frame 2, a second frame 3, and a head strap mechanism (not shown). The first frame 2 is made from rigid material. Also referring to FIG. 3, the first frame 2 includes a pair of front lens frames 20, 21 and a first bridge member 22. The front frames 20, 21 include front surfaces 201, 211 and rear surfaces 202, 212, correspondingly. A pair of receiving grooves 202, 212 is defined on the front surfaces 201, 211 for receiving lens 5. The first bridge member 22 is integratedly disposed on the inner sides of the front lens frame and includes a pair of joint sections 220, 221 which extend from the inner sides of the front lens frame 20, 21, and a bending point 23 which connects the joint sections 220, 221 adjacent to a central point thereby providing a desired flexibility of the first bridge member 22. Moreover, a strengthening bar 24 is further formed between the joint section 220, 221 of the first bridge member 22 and the bending point 23 thereby strengthening the joint section 220, 221. Thereafter, a joint holder 25 extends from the rear surface 202, 212 of the front lens frame and defines a pair of passage holes 251, 252 (Referring to FIG. 5) for being assembled with the head strap (not shown) of the head strap mechanism.

The second frame 3 is made from a soft material. Referring to FIG. 2, the second frame 3 includes a pair of rear lens frames 30, 31 and a second bridge member 32. The rear lens frames 30, 31 include a pair of front surfaces 301, 311 and rear surfaces 302, 312. The front surfaces 301, 311 are adjacent to the rear surfaces 202, 212 of the front lens frames 20, 21 and encircle the joint holder 25 of the front lens frames 20, 21. A pair of gaskets 6 is integratedly formed on the rear surfaces of the rear lens frames 302, 312. The second bridge member 32 is disposed between the inner sides of the rear lens frames 30, 31 and encircled the first bridge member 22. In other words, when the second frame 3 will be molded, the first frame 2 is set on a mold of the second frame 3. Then, the second frame 3 is made all together with the first frame 2 by injection molding thereby encircling the joint holders 25 of the front lens frames 20, 21 of the first frame 2 and assembling the first frame 2 and the second frame 3.

Figure 4:
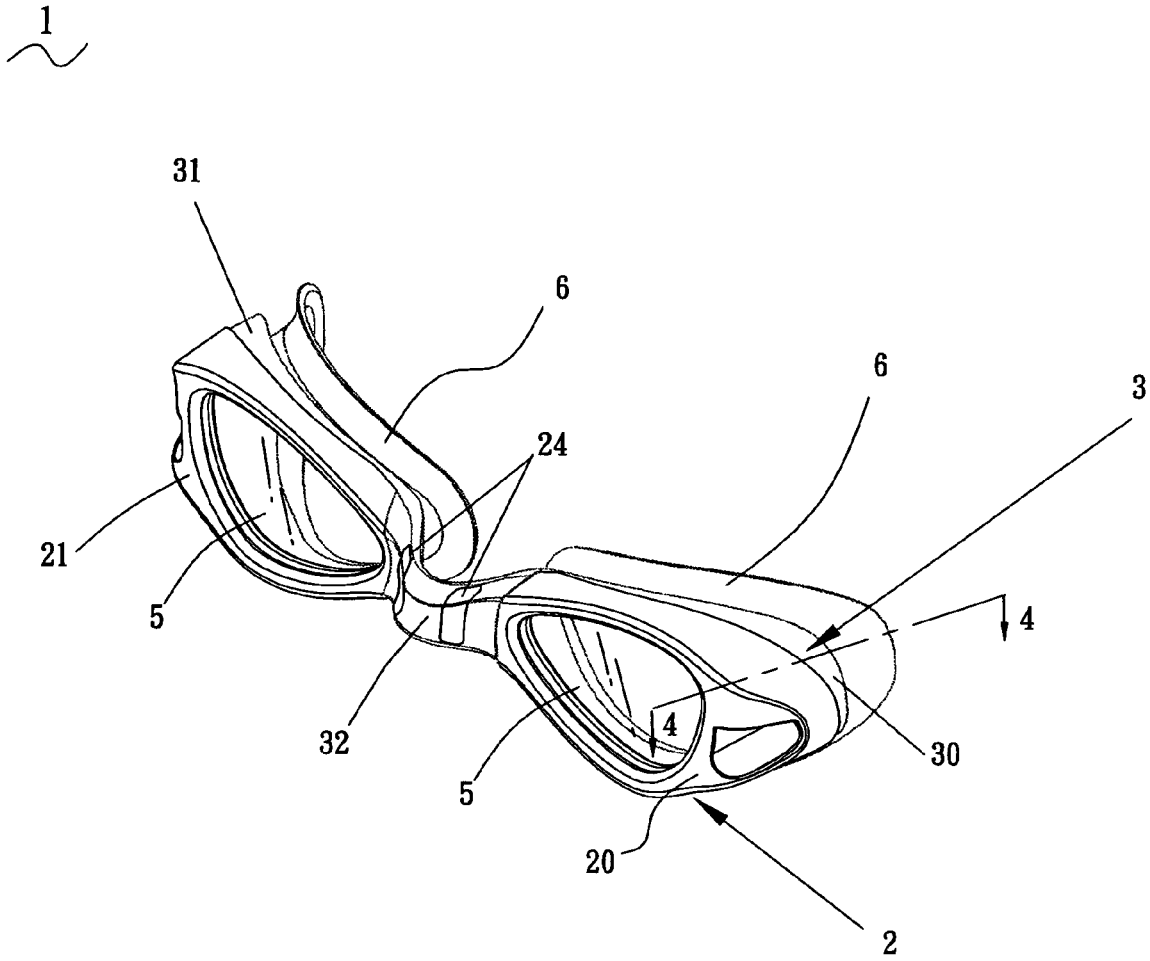
FIG. 4 is an assembled view of FIG. 5.

Referring to FIG. 4, the second frame 3 is coupled with the first frame 2. The first bridge member 22 of the swimming goggles 1 is encircled within the second bridge member 32. Due to the bending point 23 of the first bridge member 22 (also referring to FIG. 3), the second bridge member 32 adopts the bending point 23 as a central point thereby providing the front lens frames 20, 21 and the rear lens frames 30, 31 of the assembled first and second frames 2, 3 with a desired flexibility. Therefore, when the swimming goggles are used, the front lens frames 20, 21 and the rear lens frames 30, 31 are pulled by the head strap such that the front lens frames 20, 21 and the rear frames 30, 31 are properly attached to the user's face thereby providing a desired wearing effect.

Although the invention has been explained in relation to its preferred embodiments, it is to be understood that many other possible modifications and variations can be made without departing from the spirit and scope of the invention as hereinafter claimed.

What is claimed is:

1. An improved integrated swimming mechanism comprising:

a first frame, made from rigid material, including a pair of front lens frames and a first bridge member, the first lens frames each including a front surface and a rear surface, a receiving groove being defined on the front surface for receiving the lens, the first bridge member being integratedly disposed on the inner sides of the front lens frame and including at least one joint section and at least one bending point;

a second frame, made from soft material, including a pair of rear lens frames and a second bridge member, the rear lens frames each including a front surface and rear surface, the front surfaces being adjacent to and firmly connected to the rear surfaces of the front lens frames, the second bridge being disposed on the inner sides of the rear lens frames and encircling the first bridge member; and a head strap mechanism being disposed on the lateral portion of the first frame.

2. The improved integrated swimming goggle mechanism as claimed in claim 1, wherein the first bridge member includes a pair of joint sections which extend from the inner sides of the front lens frame and a bending point which connects the joint sections adjacent to a central point.

3. The improved integrated swimming goggle mechanism as claimed in claim 2, wherein a strengthening bar is further formed between the joint section of the first bridge member and the bending point.

4. The improved integrated swimming goggle mechanism as claimed in claim 1, wherein a joint holder is disposed on the lateral portion of the front lens frame, extends from the rear surface of the front lens frame toward to the rear lens frame, and defines a pair of passage holes.

5. The improved integrated swimming goggle mechanism as claimed in claim 4, wherein the rear lens frame encircles the joint holder of the front lens frame thereby assembling with the front lens frame, when molding.

6. The improved integrated swimming goggle mechanism as claimed in claim 1, wherein a gasket is integratedly formed on the rear surface of the rear lens frame.

7. An improved integrated swimming mechanism comprising:

a left lens frame and right lens frame, each lens frame including a front surface and rear surface, a receiving groove being defined in the front surface for receiving a lens;

a bridge member, disposed on the inner sides of the left lens frame and right lens frame, said bridge member at least including a joint section and a bending point, and a head strap mechanism disposed on the outer sides of the left and right lens frames, wherein the bridge member includes a pair of joint sections each extending from the inner sides of the left and right lens frame, and includes the bending point which connects the joint sections adjacent to a central point, wherein a strengthening bar is further formed between the joint sections of the bridge member and the bending point.

* * * * *